US006942716B2

(12) United States Patent
Knott et al.

(10) Patent No.: US 6,942,716 B2
(45) Date of Patent: Sep. 13, 2005

(54) PRODUCTION OF METAL FORMS

(75) Inventors: Wilfried Knott, Essen (DE); Andreas Weier, Essen (DE); Dagmar Windbiel, Essen (DE)

(73) Assignee: Goldschmidt GmbH, Essen (DE)

( * ) Notice: Subject to any disclaimer, the term of this patent is extended or adjusted under 35 U.S.C. 154(b) by 99 days.

(21) Appl. No.: 10/147,152

(22) Filed: May 16, 2002

(65) Prior Publication Data

US 2002/0170391 A1 Nov. 21, 2002

(30) Foreign Application Priority Data

May 19, 2001 (DE) ..... 101 24 533

(51) Int. Cl.[7] ..... B22F 3/10
(52) U.S. Cl. ..... 75/415; 75/228; 419/2
(58) Field of Search ..... 75/415, 228; 419/2

(56) References Cited

U.S. PATENT DOCUMENTS

| | | | | | |
|---|---|---|---|---|---|
| 3,297,431 | A | * | 1/1967 | Ridgway, Jr. | 75/415 |
| 3,940,262 | A | * | 2/1976 | Niebylski et al. | 75/415 |
| 5,393,485 | A | * | 2/1995 | Worz et al. | 419/41 |
| 5,865,237 | A | * | 2/1999 | Schorghuber et al. | 164/79 |
| 5,972,285 | A | * | 10/1999 | Knott | 419/2 |
| 6,332,907 | B1 | * | 12/2001 | Brungs | 75/255 |
| 6,444,007 | B1 | * | 9/2002 | Knott et al. | 75/228 |

FOREIGN PATENT DOCUMENTS

| | | |
|---|---|---|
| DE | 195 01 508 C1 | 4/1996 |
| DE | 197 44 300 A1 | 4/1998 |
| JP | 3-17236 | 1/1991 |
| JP | 9-241780 | 9/1997 |
| WO | WO 92/21457 | 12/1992 |

OTHER PUBLICATIONS

Merriam–Websters Collegiate Dictionary Tenth Edition 1993 p. 31.*

Proceedings of a symposium held during the TMS Annual Meeting in Orland, Florida, Feb. 9–13, 1997, *Synthesis/Processing of Lightweight Metallic Materials II*, edited by C.M. Ward–Close, et al., 289–300. The Minerals, Metals & Materials Society, 1997.

Guiping, et al, An Approach to the Factors Influencing the preparation of Foam Metal by Infiltration Method, Foundry, vol. 2, 1997, pp. 1–4.

* cited by examiner

*Primary Examiner*—Melvyn Andrews
(74) *Attorney, Agent, or Firm*—Frommer Lawrence & Haug LLP

(57) ABSTRACT

The invention relates to a process for producing metal foams of controlled structure and to the metal bodies in foam form obtained in this way, wherein metals from group IB to VIIIB of the periodic system of the elements are added before and/or during the formation of the foam.

8 Claims, 1 Drawing Sheet

PRODUCTION OF METAL FORMS

RELATED APPLICATIONS

This application claims priority to 101 24 533.5, filed May 19, 2001, herein incorporated by reference.

BACKGROUND OF THE INVENTION

1. Field of the Invention

The invention relates to a process for producing metal foams of controlled structure and to the metal bodies in foam form which are obtained in this way.

2. Description of the Related Art

The prior art for the production of metal foams substantially comprises five basic procedures:

1. the compacting of metal powders with suitable blowing agents and heating of the preforms obtained in this way to temperatures which are higher than the liquidus temperature of the metal matrix and higher than the decomposition temperature of the blowing agent used;
2. dissolving or blowing of blowing gases into metal melts;
3. stirring of blowing agents into metal melts;
4. sintering of metallic hollow spheres;
5. infiltration of metal melts into filler bodies, which are removed after the melt has solidified.

Regarding the first procedure, DE-A-197 44 300 deals with the production and use of porous light metal parts or light-metal alloy parts, the bodies which have been compressed from a powder mixture (light-metal or Al alloy and blowing agent) being heated, in a heatable, closed vessel with inlet and outlet openings, to temperatures which are higher than the decomposition temperature of the blowing agent and/or melting temperature of the metal or of the alloy.

With respect to the second procedure, JP 03017236 A describes a process for producing metallic articles with cavities by dissolving gases in a metal melt and then initiating the foaming operation by suddenly reducing the pressure. Cooling of the melt stabilizes the foam obtained in this way.

WO 92/21457 teaches the production of Al foam or Al alloy foam by blowing in gas beneath the surface of a molten metal, abrasives, such as for example SiC, $ZrO_2$ etc., being used as stabilizers.

Concerning the third procedure, according to the teaching given in JP 09241780 A, metallic foams are obtained with the controlled release of blowing gases as a result of the metals initially being melted at temperatures which lie below the decomposition temperature of the blowing agent used. Subsequent dispersion of the blowing agent in the molten metal and heating of the matrix to above the temperature which is then required to release blowing gases leads to a metal foam being formed.

Regarding procedure 4, the production of ultralight Ti—6Al—4V hollow sphere foams is based on the sintering, which takes place at temperatures of $\geqq 1000°$ C., of hydrated Ti—6Al—4V hollow spheres at 600° C. (Synth./Process. Lightweight Met. Mater. II, Proc. Symp. 2nd (1997), 289–300).

With respect to procedure 5, foamed aluminum is obtained by, after infiltration of molten aluminum into a porous filler, by removal of the filler from the solidified metal (Zhuzao Bianjibu (1997) (2) 1–4; ZHUZET, ISSN: 1001–4977).

Furthermore, components with a hollow profiled section are of particular interest for reducing weight and increasing rigidity. DE-A-195 01 508 deals with a component for the chassis of a motor vehicle which comprises die-cast aluminum and has a hollow profiled section, in the interior of which there is a core of aluminum foam. The integrated aluminum foam core is produced in advance by powder metallurgy and is then fixed to the inner wall of a casting die and surrounded with metal by die-casting.

When assessing the prior art, it can be observed that the processes, which provide for preliminary compacting of preforms and which contain blowing agent, are complex and expensive and are unsuitable for mass production. Moreover, a common feature of these processes is that the desired temperature difference between the melting point of the metal, which is to be foamed, and the decomposition temperature of the blowing agent used should be as low as possible, since otherwise disruptive decomposition of blowing agent takes place even during compacting or later in the melting phase. This observation applies in a similar way to the introduction of blowing agents into metal melts.

The sintering of preformed hollow spheres to form a metallic foam is at best of academic interest, since even the production of the hollow spheres requires a complex procedure.

The infiltration technique has to be considered in a similar way, since the porous filler has to be removed from the foam matrix, which is a difficult operation. The dissolving or blowing of blowing gases into metal melts is not suitable for the production of near net shape components, since a system comprising the melt with occluded gas bubbles is not stable for a sufficient time for it to be processed in shaping dies. The mechanical properties of metal foams are substantially—in addition to the selection of the metal or alloy used—determined by their structure.

However, the linked procedures which take place during the production of porous metal bodies often—in particular in the case of the method which is based on the use of chemical blowing agents—do not provide the desired result of a uniform metal foam which has globular cells of similar dimensions. Associated with this is, for example, a lack of isotropy of the bulk density, which could be desirable for the subsequent function of the metal foam in numerous structural components. Instead, there are irregularities, in the form of thickened zones in the metal body (for example a pronounced foot and/or edge zone formation and/or associated cavities which result from individual gas bubbles combining with one another as a result of the cell membranes being destroyed). At the same time, the occurrence of irregularities of this nature may indicate a relatively inefficient utilization of blowing agent.

OBJECTS OF THE INVENTION

Therefore, an object of the present invention is defined as being that of finding a method which can be utilized on an industrial scale for specifically controlling the structure of the metal foams produced using chemical blowing agents. Another object related to the first is the aim of improving the utilization of blowing agent used (for example of a metal hydride).

SUMMARY OF THE INVENTION

Therefore, a first embodiment which achieves the above-mentioned object is a process for producing metal foams wherein metals from group IB to VIIIB of the periodic system of the elements are added before and/or during the formation of the foam.

Surprisingly, it has now been found that metals from groups IB–VIIIB of the periodic system of the elements, in particular as additives to systems acted on by hydride, act so as to control morphology in the sense of the above object, and significantly increase the efficiency of the blowing agent. The added metals from groups IB to VIIIB of the periodic system of the elements may be applied either individually or in the form of a mixture of a plurality of metals.

DETAILED DESCRIPTION

Figure 1:
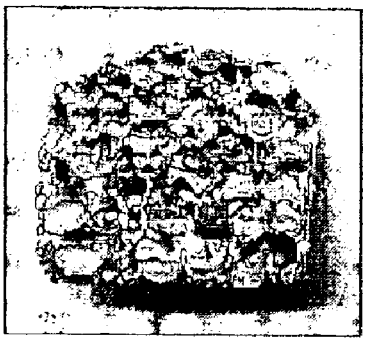
FIG. 1 is a photocopy of a photograph which depicts a cross-section of foamed body prepared in Example 1.

The process according to the invention therefore provides, in a preferred embodiment, for the matrix consisting of light metal or light metal alloy and hydride blowing agent to be expanded by small amounts of titanium, copper, iron, vanadium and mixtures thereof. The metallic additives are particularly preferably used in amounts of from about 0.001% by weight to about 1% by weight, particularly preferably from about 0.01% by weight to about 0.1% by weight, based on the metal which is to be foamed, in particular on the light metal which is to be foamed.

A particularly preferred blowing agent in the context of the present invention is magnesium hydride, in particular autocatalytically produced magnesium hydride, the production of which is known from the literature. Furthermore, this magnesium hydride is commercially available under the name Tego Magnan® from Goldschmidt AG, Essen Germany. In general, the quantity of blowing agent may be varied within the standard limits of about 0.1% by weight to about 5% by weight, preferably from about 0.25% by weight to about 2% by weight.

The exploitation of the observed phenomenon ensures the production of highly regular foam structures and the reproducibility of morphologically uniform metal foams which is required with a view to technical applications. Employing the process according to the invention during the foaming process can make a considerable contribution to suppressing the destruction of the cell membrane.

Criteria for assessing the quality of plastic foams and of metal foams include, in addition to the visually perceptible homogeneity, the expansion achieved and, as a corollary, the final density of the porous metal body.

The general principle of the present invention is to be demonstrated here using the powder metallurgy route (mixing of light metal powder with hydride blowing agent and, if appropriate, additives, pre-compacting and/or pressing the matrix to form preforms, heating the preforms to temperatures which are higher than the melting point of the metal which is to be foamed). Naturally, applying the additives claimed in the present invention to a metal-hydride system in accordance with the invention is not restricted to the powder metallurgy route, but rather also covers systems which can be considered to form part of melt metallurgy.

EXAMPLES

Example 1

500 g of aluminum powder with a purity of 99.5% were mixed, with stirring, with 1% by weight of Tego Magnan® (magnesium hydride, hydride content 95%), based on the quantity of aluminum powder, and 0.1% by weight of titanium powder, based on the quantity of aluminum powder, and 0.01% by weight of copper powder, based on the amount of aluminum powder. Cylindrical pressed bodies were produced from this mixture by cold isostatic pressing. The degree of compacting of the pressed bodies obtained in this way was 94 to 97% of the density which can theoretically be achieved.

In an induction furnace with a HF output power of 1.5 kW, the pressed bodies were foamed freely in a graphite crucible at a heating rate of 300° C./min. The foamed bodies were cooled rapidly 30 seconds after the foaming operation had commenced.

After the samples had been sawn open, homogeneously distributed globular cells with a mean diameter of 3 mm, as illustrated in FIG. 1, were apparent all the way to the edge regions. The density achieved was 0.5 g/cm$^3$.

Example 2

In a similar manner to Example 1, 500 g of aluminum powder were mixed with 1% by weight of Tego Magnan® (magnesium hydride), based on the amount of aluminum powder, 0.1% by weight of titanium powder, based on the amount of aluminum powder, and 0.01% by weight of vanadium powder, based on the amount of aluminum powder. The mixture was compacted as described above. The degree of compacting of the cylindrical pressed bodies obtained in this way was 94 to 96%.

After the foaming and sawing, a fine, homogeneous cell structure was visible, with a mean size of 1.5 to 2 mm and a density of 0.6 g/cm$^3$.

Figure 2:
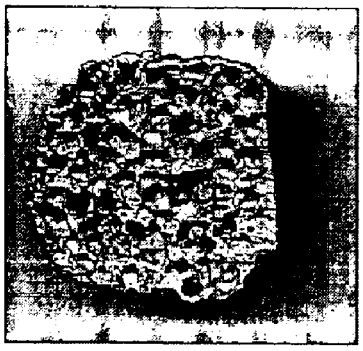
FIG. 2 is a photocopy of a photograph which depicts a cross-section of the foamed structure prepared in Example 2.

The foam structure formed is documented by FIG. 2.

Example 3

In a similar manner to Example 1, 500 g of aluminum powder, 1% by weight of Tego Magnan® (magnesium hydride), based on the amount of aluminum powder, 0.1% by weight of titanium powder, based on the amount of aluminum powder, and 0.01% by weight of iron powder, based on the amount of aluminum powder, were mixed and compacted, and the preforms obtained were foamed. After the sawing operation, a homogeneous structure with a mean cell size of 5 mm was visible. The measured density was 0.7 g/cm$^3$.

Figure 3:
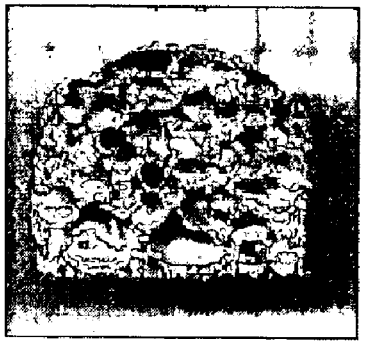
FIG. 3 is a photocopy of a photograph which depicts a cross-section of the foamed structure prepared in Example 3.

The foam structure formed is documented by FIG. 3.

Example 4

In a similar manner to Example 1, 500 g of aluminum powder, 1% by weight of Tego Magnan® (magnesium hydride), based on the amount of aluminum powder and 0.1% by weight of titanium powder, based on the amount of aluminum powder, were mixed and compacted. The degree of compacting was between 95 and 97% of the density which can theoretically be achieved. The preforms obtained in this way were foamed, and after sawing a homogeneous structure with a mean cell size of 3.5 to 4 mm was apparent. The measured density was 0.3 g/cm$^3$.

Figure 4:
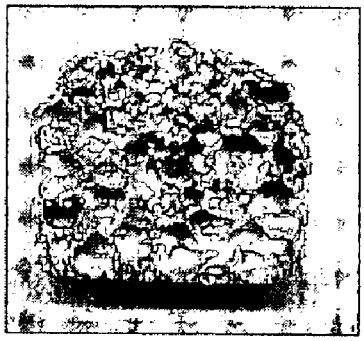
FIG. 4 is a photocopy of a photograph which depicts a cross-section of the foamed structure prepared in Example 4.

The foam structure formed is documented by FIG. 4.

Reference Example 1

In a similar manner to Example 1, 500 g of aluminum powder, 0.1% by weight of titanium hydride, based on the amount of aluminum powder, and 0.1% by weight of titanium powder, based on the amount of aluminum powder, were mixed, compacted and foamed freely. After sawing, a coarse, highly heterogeneous foam structure with a mean cell size of 8 mm was visible. A number of pore membranes had broken open. The density achieved was 0.7 g/cm$^3$.

Figure 5:
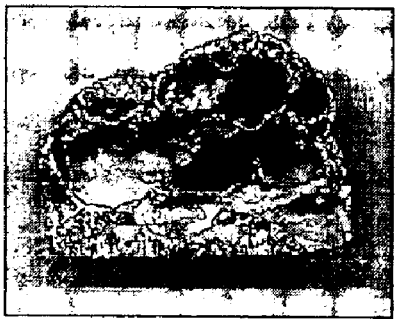
FIG. 5 is a photocopy of a photograph which depicts a cross-section of the foamed structure prepared in Reference Example 1.

The foam structure formed is documented by FIG. 5.

Reference Example 2

In a similar manner to Comparative Example 1, 500 g of aluminum powder, 0.1% by weight of titanium hydride, based on the amount of aluminum powder, and 0.1% by weight of copper powder, based on the amount of aluminum powder, were mixed and compacted. After the foaming and sawing, a broken-open, inhomogeneous structure with a mean pore size of 5.5 mm and a substantially solid base was revealed. The density achieved was 0.5 g/cm$^3$.

Figure 6:
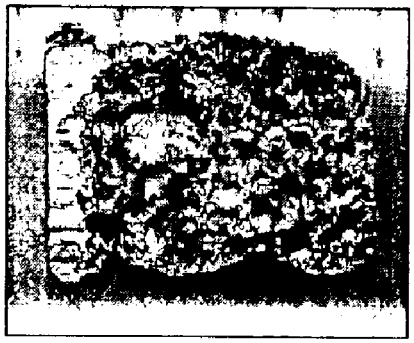
FIG. 6 is a photocopy of a photograph which depicts a cross-section of the foamed structure prepared in Reference Example 2.

The foam structure formed is documented by FIG. 6.

It was clearly demonstrated that the inventive addition of small quantities of transition metals and/or their mixtures had a considerable influence on the morphology and final density of the foamed metal bodies.

The above description of the invention is intended to be illustrative and not limiting. Various changes or modifications in the embodiments described herein may occur to those skilled in the art. These changes can be made without departing from the scope or specification of the invention.

What is claimed is:

1. A process for preparing an aluminum or an aluminum alloy metal foam which comprises forming a matrix comprising the aluminum or aluminum metal alloy and magnesium hydride and adding, either before foaming or during foaming the matrix, 0.001% to 1% by weight, based on the aluminum or aluminum metal alloy, a metallic additive selected from the group consisting of a Group IB to Group VIIIB metal powder and mixture of said metal powders.

2. The process according to claim 1, wherein the aluminum or the aluminum metal alloy is in the form of a powder.

3. The process according to claim 1, wherein the Group IB to VIIIB metal is selected from the group consisting of titanium, copper, iron, vanadium and a mixture of said metals.

4. The process according to claim 1, wherein the amount is from about 0.01% to about 0.1% by weight.

5. The process according to claim 1, wherein the magnesium hydride is present in an amount from about 0.1% to about 5% by weight, based upon the aluminum or aluminum metal alloy that is to be foamed.

6. The process according to claim 1, wherein the magnesium hydride is autocatalytically produced.

7. The process according to claim 1, wherein the foaming occurs by compacting the matrix comprising the aluminum or aluminum alloy powder and the magnesium hydride, placing the compacted matrix into a preform, and heating the perform to a temperature which is higher than the liquidus temperature of the aluminum or aluminum metal alloy and the decomposition temperature of the magnesium hydride.

8. The process according to claim 1, wherein the matrix comprises an aluminum metal melt and the magnesium hydride has been stirred into the aluminum metal melt.

* * * * *